US005737729A

United States Patent [19]

Denman

[11] Patent Number: 5,737,729

[45] Date of Patent: Apr. 7, 1998

[54] INTERACTIVE KIOSK FOR SELECTING AND SENDING MAIL PIECES

[76] Inventor: Donald E. Denman, 91 Norman Ridge Dr., Bloomington, Minn. 55437

[21] Appl. No.: 657,963

[22] Filed: Jun. 4, 1996

[51] Int. Cl.[6] ..... G07B 17/00

[52] U.S. Cl. ..... 705/401; 364/479.01; 364/479.02; 364/479.03; 364/479.05; 705/408; 705/410

[58] Field of Search ..... 364/464.11, 464.14, 364/464.18, 464.2, 479.01, 479.02, 479.03, 479.05, 479.06; 395/201, 216, 220, 224, 226, 227; 705/1, 16, 20, 24, 26, 27, 401, 404, 408, 410

[56] References Cited

U.S. PATENT DOCUMENTS

| | | | |
|---|---|---|---|
| 3,864,708 | 2/1975 | Allen | 354/290 |
| 4,410,961 | 10/1983 | Dlugos et al. | 364/900 |
| 4,712,909 | 12/1987 | Oshikoshi | 355/20 |
| 4,800,505 | 1/1989 | Axelrod et al. | 364/478 |
| 4,970,655 | 11/1990 | Winn et al. | 364/479 |
| 5,056,029 | 10/1991 | Cannon | 364/468 |
| 5,072,253 | 12/1991 | Patton | 355/40 |
| 5,085,470 | 2/1992 | Peach et al. | 283/58 |
| 5,180,906 | 1/1993 | Yamada | 235/487 |
| 5,313,404 | 5/1994 | Wu | 364/478 |
| 5,457,636 | 10/1995 | Sansone et al.. | 364/478 |
| 5,477,462 | 12/1995 | McClung | 364/464.02 |
| 5,481,464 | 1/1996 | Ramsden | 364/464.03 |
| 5,513,116 | 4/1996 | Buckley et al. | 364/479.03 |
| 5,513,117 | 4/1996 | Small | 364/479.03 |
| 5,546,316 | 8/1996 | Buckley et al. | 364/479.03 |
| 5,552,994 | 9/1996 | Cannon et al. | 364/468.01 |
| 5,555,496 | 9/1996 | Tackbary et al. | 395/227 |
| 5,615,123 | 3/1997 | Davidson et al. | 364/479.03 |
| 5,617,528 | 4/1997 | Stechmann et al. | 395/326 |

*Primary Examiner*—Edward R. Cosimano
*Attorney, Agent, or Firm*—Haugen & Nikolai, PA

[57] ABSTRACT

The present invention is an apparatus and method for selecting and sending mail pieces via an interactive kiosk. The interactive kiosk contains a microprocessor system programmed to interact with the customer for selecting a mail piece of choice. The microprocessor then displays queries and options for the purchaser to add a personalized message to the post card. The customer may also input the address or utilize an address locator feature for retrieving the address from a data base located in the kiosk. The kiosk then prompts the customer for payment via an electronic bill or credit card accepter. After the customer has completed using the kiosk, the kiosk communicates with a central processing location. The central processing location includes a microprocessor based system which electronically downloads the necessary information from the kiosk including the post card orders and customer/sales information. If the customer enters a physical street or post office box address, the customer text and address is printed onto the specific post card selected. Postage is affixed to the post card and the post card is then sent to the recipient. If an electronic mail address is used, a graphics file is created with the selected mail piece and customer text. The graphics file is then transmitted to the electronic mail address.

29 Claims, 6 Drawing Sheets

INTERACTIVE KIOSK FOR SELECTING AND SENDING MAIL PIECES

FIELD OF INVENTION

The present invention relates to the selecting and sending of mail pieces and more particularly to an automated, unattended interactive kiosk displaying an array of mail pieces which a consumer may select and personalize with a message, with the interactive kiosk connected to a remote location for the task of sending the selected mail piece with the consumer's personalized message.

BACKGROUND OF THE INVENTION

Consumer post cards are widely used in the United States. In 1995, more than 2½ billion private post cards were mailed according to the U.S. Post Office National Library. Post cards are frequently sent out on business trips or vacations. However, finding and sending post cards can be time consuming while on such trips because post cards, postage and a mail box are often not located in the same area. The traveler often finds a gift shop that sells post cards, then must find a post office or vending machine that sells stamps and then must find a mail box for mailing the post card. As a result, travelers may never send the post cards or wait until they get home to send the post cards.

Interactive kiosks have been used in the preparing of mail pieces. For example, interactive postal kiosks and unattended drop off boxes for commercial delivery businesses are well known. Such kiosks or unattended drop boxes process a pre-addressed mail piece. The mail pieces are deposited in the kiosk or drop box where they are weighed, the postage due is calculated and the kiosk has means for accepting payment from the customer. After payment by the customer, the postage is affixed to the mail piece and it remains in the kiosk or drop box until it is picked up by an employee of the commercial delivery service.

Another approach has been to use interactive kiosks for dispensing a specific mail piece, such as a post card, as shown in U.S. Pat. No. 5,457,636 to Sansone, et al and U.S. Pat. No. 3,864,708 to Allen. The Sansone patent shows an interactive kiosk incorporating a touch screen and keyboard used to select a particular post card and enter the address of the recipient. The kiosk then prints the selected post card with the mailing address only. The Allen patent shows a booth that will photograph the individual and dispense the photograph on a post card. With both devices, the customer must manually write a message on the post card, obtain postage and then mail the post card.

What is missing in the prior art is a device that not only provides a selection of mail pieces, such as post cards, from which to choose and the ability to personalize the post card with a message and address but also providing at a central location the service of preparing and sending the selected mail piece with the customer's message to a physical address or electronic mail address.

The primary object of the present invention is to provide an interactive kiosk that allows an individual to select and send post cards or mail pieces at one location without worrying about finding another location for buying the appropriate postage, finding a mail box or even bringing along the address of the post card recipient.

A further object of the present invention is to provide an interactive kiosk intended to be used in tourist areas that provides post card selections associated with the location of the kiosk.

Still another object of the present invention is to provide an interactive kiosk with a post card selection service and a mailing service for sending the post card with the address and message entered by the customer, with the mailing service capable of sending a digitized post card and message to an electronic mail (E-mail) address or sending a printed post card to a physical address, such as a street or post office box.

A still further object of the present invention is to provide an interactive kiosk that provides stationary or note cards specific to the location of the kiosk thereby allowing the customer to select a specific design, enter a message and the recipient's address, with the kiosk providing the service of posting the mail piece with the customer's entered information.

Another object of the present invention is to provide a plurality of interactive kiosks in communication with a central processing location, with the interactive kiosks displaying an array of mail pieces to be selected by a customer, allowing the customer to enter a message and the recipient's address or use an address search database and with the central processing location printing and sending the selected mail piece with the customer's entered information.

SUMMARY OF THE INVENTION

The present invention is an interactive kiosk for purchasing and sending post cards or other mail pieces. The kiosk houses a microprocessor linked to an interactive touch screen monitor, a keyboard and speaker used to communicate with the customer. The monitor displays a selection of mail pieces, such as post cards. The microprocessor incorporates graphics and software applications, which allow the customer to select a post card, enter text on the post card and enter the recipient's address. The address can be an E-mail address or a physical address such as a street or post office box. The microprocessor is also programmed to verify the customer's entered text. In an alternative embodiment, the kiosk also supports a data base of addresses located on CD ROMS supported by a CD ROM driver means linked to the microprocessor. The data base of addresses may be in the memory of the microprocessor or other means such as databases commercially available and accessible over the Internet. The microprocessor is programmed to interface with the customer to access the address data base.

The kiosk has a conventional electronic money acceptor and/or credit card acceptance terminal linked to the microprocessor. The microprocessor is programmed to calculate the customer's fee order based on the number of post cards selected and communicates with the money/credit card acceptor to receive payment from the customer. Once the correct fee has been paid, the customer is thanked and a receipt may be printed.

The printing and sending of the customer's selected post card are completed at a central processing location. Order information and statistical information on kiosk use are electronically transferred from each kiosk to a microprocessor at a central processing location. The post card orders and kiosk statistics are then sorted in the central processing microprocessor. Each order and related text are printed either directly to the selected post card or onto an adhesive label customized to fit the back of a post card ordered by the customer. Alternatively, the post card is digitally stored in the computer for use in printing the postcard or sending the post card via electronic mail (E-mail). If the digitally stored post card is to be printed, a full color duplex printer may be used to simultaneously print the post card and the text on appropriate card stock. If an E-mail address is given, the microprocessor creates a graphics file for the post card and text for sending via E-mail.

The post card text will preferably include the recipient's name, the customer's message, the customer's name, the recipient's mailing address with its matching postnet bar code for ease in mailing or the recipient's E-mail address, the post card type number and the name, city and state where the post card or mail piece originated. The post card is then sent via the U.S. Postal Service, a commercial delivery service or over the Internet if an E-mail address is given.

The statistical information from each kiosk, which can include information such as sales totals, most frequently ordered post card, numbers of post cards selected by customer, is stored in the microprocessor and can be retrieved in a desired report manner.

DESCRIPTION OF THE DRAWINGS

The foregoing features, objects and advantages of the invention will become apparent from the following detailed description of the preferred embodiment, especially when considered with the accompanying drawings in which.

DESCRIPTION OF THE PREFERRED EMBODIMENT

Figure 1:
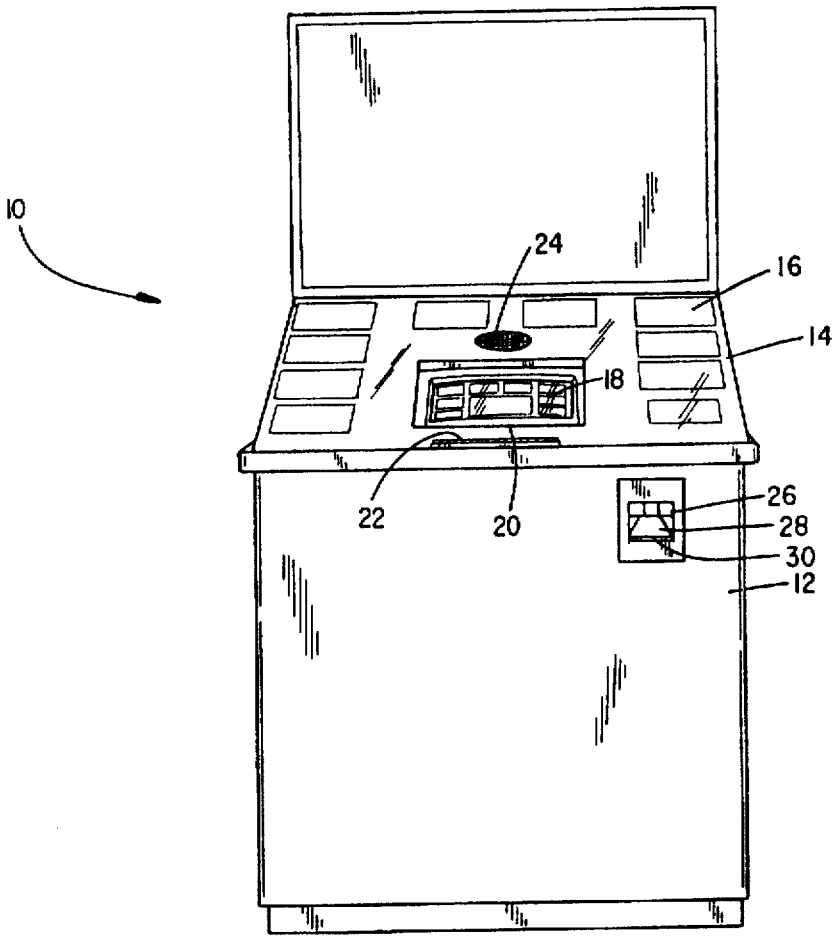
FIG. 1 is an interactive kiosk incorporating the features of the present invention.

Turning now to FIG. 1 there is shown an interactive kiosk designated 10. The kiosk is an independent, stand alone, unattended unit that interacts with a consumer via a menu driven prompt. The kiosk includes a housing 12 that houses a microprocessor and a modem for communication with a remote central processing location, as will be described later. While the preferred description will describe one kiosk, it is intended that a plurality of such kiosks in different locations are linked with the central processing location. The exterior of the kiosk housing 12 includes a panel 14 that can be used for displaying mail pieces, one of which is designated 16, that are preferably associated with the location of the kiosk 10. The description of the preferred embodiment will refer to a post card as a type of mail piece displayed, however, it is understood that other mail pieces such as note paper or cards may be used.

A monitor 18 is in a recess 20 formed in the panel 14 of the kiosk housing 12. The monitor 18 preferably has touch screen capabilities, such as a touch screen monitor from Elo Touch. Systems of Oakridge, Tenn. A conventional keyboard 22 is supported on the kiosk housing 12 for a customer interface, although a keyboard may be a feature of the touch screen monitor 18. The kiosk housing 12 includes a speaker 24, such as an Audi-File speaker, for communication with the customer. A money accepter 26, such as a conventional electronic bill and change accepter made by Coin Bill Validator, Inc. of Deer Park, N.Y., is also on the kiosk housing 12. Additionally, a credit card terminal 28 can be adjacent the money acceptor 26, such as one from Zon Jr. Plus-Verifone, Inc., Costa Mesa, Calif. Lastly, a conventional receipt printer may also be included on the kiosk at 30.

Figure 2:
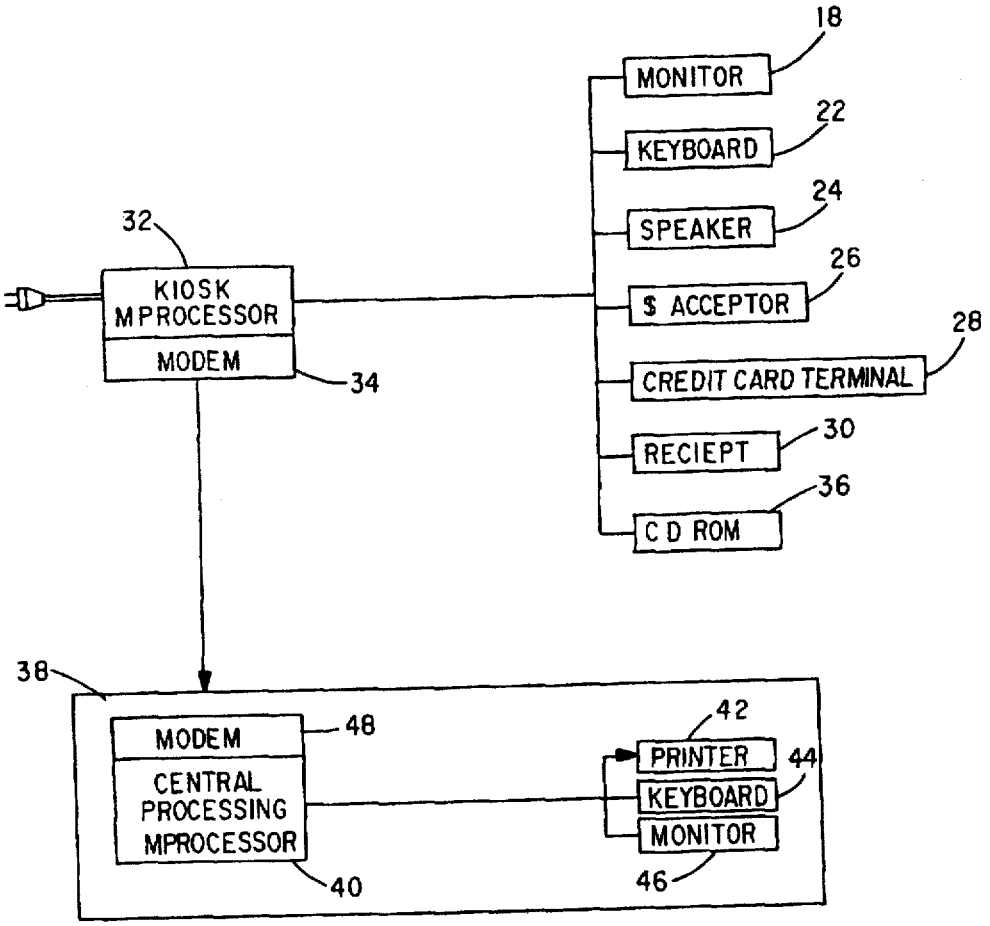
FIG. 2 is a schematic of the components of the kiosk and central processing location incorporating the present invention.

Turning now to FIG. 2, the internal features of kiosk 10 will be described. The microprocessor 32, which can be a commercially available computer system such as a pentium-based computer system with an internal modem 34 and a sound board, is supported within the kiosk housing 12. The microprocessor 32 is linked to the touch screen monitor 18, the keyboard 22 and the speaker 24 for communicating with the customer. Speaker 24 is further linked to the sound board of microprocessor 32. The microprocessor 32 is also linked to the money acceptor 26 for receiving the correct payment from the customer. The credit card terminal 28 to is also linked to microprocessor 32 and modem 34. It preferably can accept a variety of credit cards. The credit card terminal 28 contacts a credit card processing company that authorizes or declines payment from the credit card being used for the transaction through the modem 34. Lastly, the receipt printer 30 is also linked to the microprocessor 32. A CD Rom drive means 36, such as two conventional six-step drives, may also be supported within the kiosk housing 12 and linked to the microprocessor 32. The kiosk 10 is coupled to an external power source (not shown) for powering the electronic features housed therein.

The modem 34 provides the communication link with a central processing location designated 38 in FIG. 2. The central processing location 38 contains a conventional microprocessor 40, such as a pentium-based computer system with an internal modem 48. Microprocessor 40 is in communication with a printer 42, a conventional keyboard 44 and a monitor 46 that can have touch screen capabilities. The printer 42 may be a conventional printer, such as a Hewlitt-Packard laser printer, for printing directly to a post card or onto an adhesive label customized to fit the selected post card. Alternatively, a full duplex color printer, such as an IBM 3170 full color digital color printer, may be used for printing the post card and text simultaneously on appropriate card stock.

Figure 3:
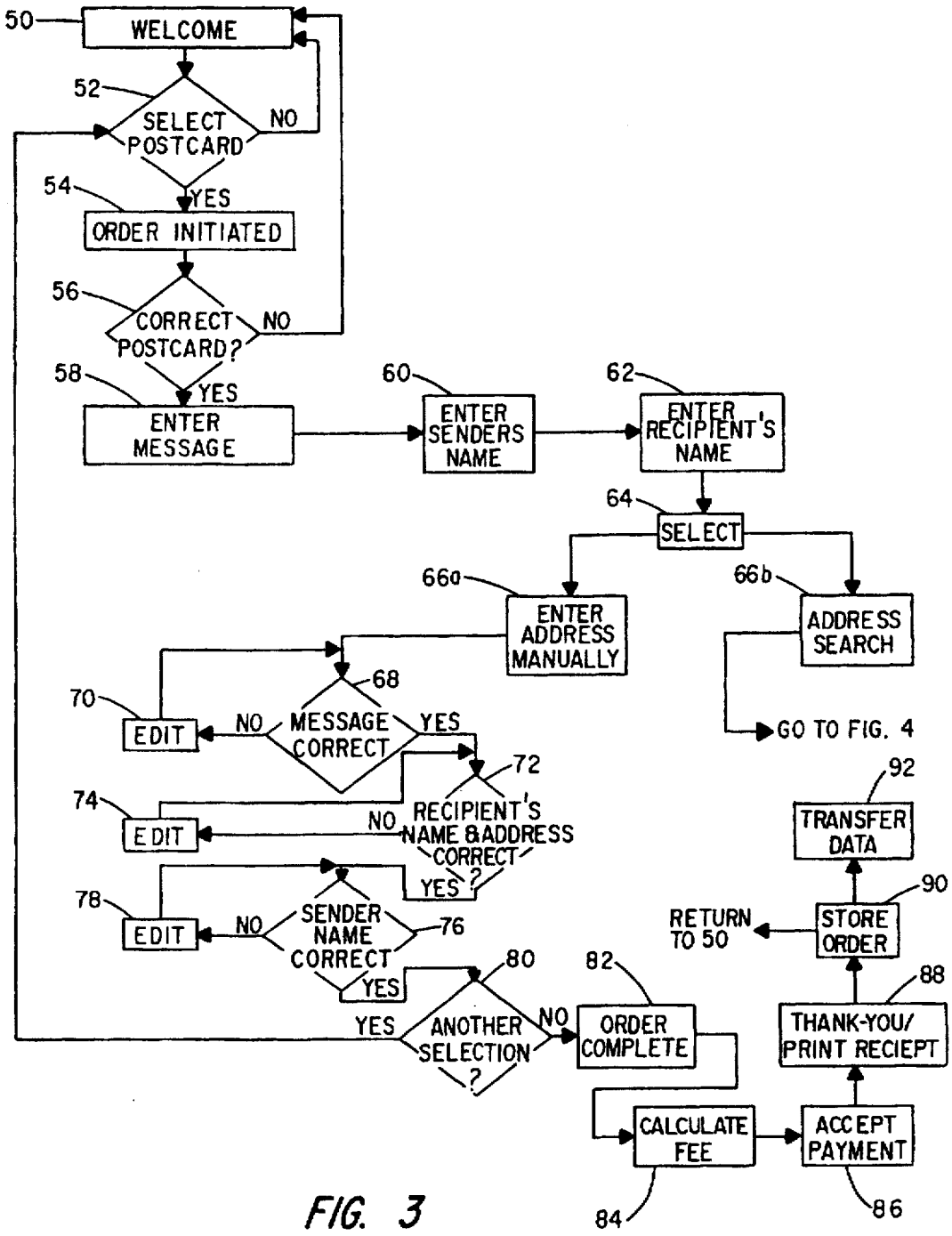
FIG. 3 is a schematic block diagram of the steps incorporating the present invention at the interactive kiosk.

The process of using the interactive kiosk 10 for selecting and sending the post card will now be described with reference to the flow charts in FIGS. 3–4 for the operations performed at the kiosk and FIG. 5 for the operations performed at the central processing location. The microprocessor 32 of kiosk 10 is programmed to interact with the customer for selecting a post card and entering specific text for printing onto the post card through a series of queries presented in an audio format though the speaker 24 and in a visual format displayed on the monitor 18 screen. Monitor 18 displays the selection of post cards and instructions. Microprocessor 32 is programmed to run continuously an audio command welcoming the customer and inviting the customer to select a post card until a post card is selected and an order is initiated (Block 50). The various post cards from which to choose can be digitally stored and displayed on the monitor 18 or the monitor can display alpha numeric designations representing the post cards displayed on the kiosk 10. Once the customer has selected a post card, microprocessor 32 receives the signal indicating a new order and initiates the postcard selection process (blocks 52–54).

Now that a post card is selected, the microprocessor 32 sends a signal to ask the customer in a visual and audio format to determine if the post card selection is correct (block 56). The customer responds by touching the monitor 18 showing a yes or no button or enters the requested command via the keyboard 22. If the post card selection is not correct, the microprocessor 32 returns to block 50 for post card selection. If the selected post card is correct, the customer is prompted through a visual and audio format to enter the message to be included on the post card (block 58), the customer/sender's name (block 60) and the recipient's name (block 62). The customer uses the keyboard 22 and enters the appropriate text at each prompt. The customer is then asked to select (block 64) whether to enter the recipient's address manually through the keyboard 22 (block 66*a*) or to use an automatic address search feature (block 66*b*). If an automatic address database is not used, the select feature is omitted and the customer is prompted to manually enter the address as in block 66*a*.

Figure 4:
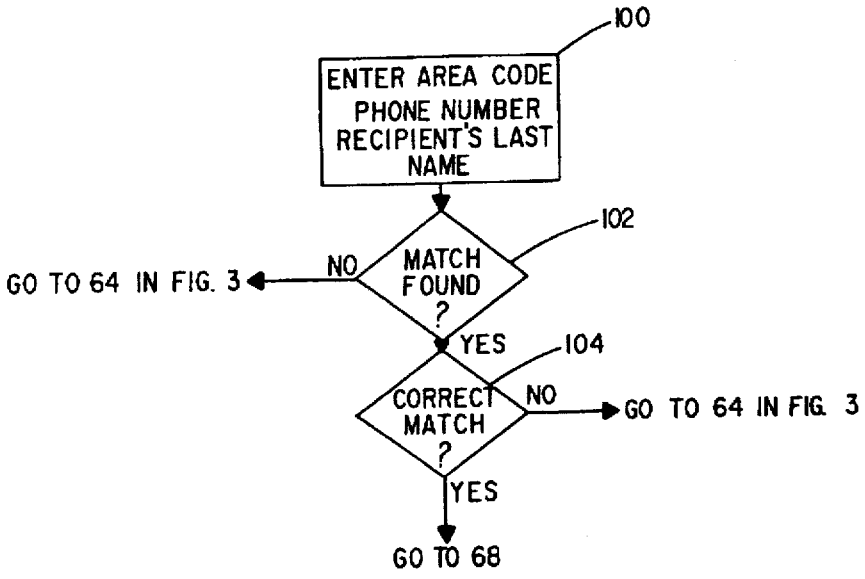
FIG. 4 is a schematic block diagram of the steps at the interactive kiosk incorporating an alternative embodiment of the present invention that features an address finder.
Figure 5:
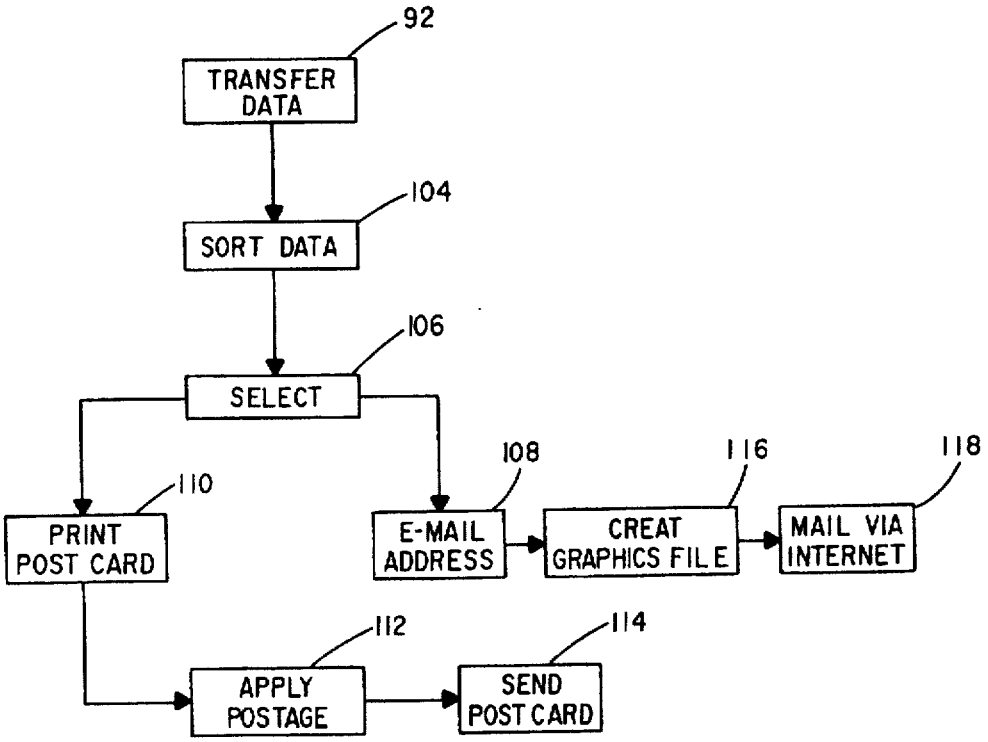
FIG. 5 is a schematic block diagram of the steps incorporating the present invention at the central processing location.

Turning now to FIG. 4, the automatic address search will be described. The address search feature uses a database containing addresses of individuals, such as the Home Phone Address database of more than 85 million listings stored on CD Rom and available from PRO CD of Danvers, Mass. This commercially available CD Rom Address Searcher finds an individual's address when given certain parameters such as the area code, telephone number and last name of an individual. As one of skill in the art can appreciate, an address database may alternatively be stored in the memory of microprocessor 32 or available over the Internet and includes U.S. and foreign addresses. As seen in block 100, the customer is prompted with an audio and visual format to enter the area code, telephone number and last name of the recipient. After the customer enters the requested information, a search for a match is conducted (block 102). If a match is found, the customer is asked to verify if the address is correct (block 104). The correct address is then added to the other customer entered information. If the address is not on the CD Rom or is incorrect, the microprocessor returns the customer to the address select block 64, where the customer may choose to enter the address manually (block 66*a*) or the customer may choose to retry the address locator feature (block 66*b*).

After the customer has entered all the requested information, including the located address, the customer is asked, again using an audio and visual format, to verify that the entered data is correct. The post card message is verified at block 68. If the message is incorrect, the customer may edit the message (block 70). Once the message is correct, the customer verifies the recipient's name and address (block 72). If the name or address is incorrect, the customer may edit the information (block 74). After the name and address have been verified, the customer then verifies that the sender's name is correct (block 76). Again, the customer can edit the information if it is incorrect (block 78). After verification of the data, the customer is asked whether another post card selection is desired (block 80).

If the customer chooses to select another post card, the selection process is repeated beginning at block 52. The process for the additional selections are the same as the first selection with the following additional features. When the customer is prompted for the message at block 58, the customer will be asked whether the customer wishes to use the message on its previous selection. If the customer responds affirmatively, the message is repeated. If the customer responds negatively, the customer may enter a new message. Likewise, the customer will be asked at 62 whether to use the same sender's name. If the customer responds negatively, the customer may enter a new sender's name.

If the purchaser chooses not to send another card, the order is completed (block 82). The cost of the order is determined by the microprocessor 32 programmed to determine the cost based on the number of selections made by the customer (block 84). The customer is prompted to enter payment and the money acceptor or credit card terminal accepts payment (block 86). After proper payment, the customer is thanked with an audio and visual message and a receipt may be printed (block 88). The microprocessor 32 stores the order information in its memory (block 90) for a later transferral to the central processing microprocessor 40 (block 92). The microprocessor 32 then returns to its continuous audio and visual message requesting a customer to enter a post card selection (block 50) until a post card is selected and an order is initiated (blocks 52–54).

The next step in the process involves transferring the order information from the individual kiosk to the central processing location through the modem 34 and 48 over a conventional telephone line or through a cellular phone transmission (block 92). There are two ways to accomplish this task. First, the microprocessor 32 at kiosk 10 can be programmed to call the central processing microprocessor 40 at a selected interval, i.e., every 24 hours, or after a preselected number of orders have been stored in microprocessor 32. Second, microprocessor 40 of the central processing location 38 can be programmed to call up each individual kiosk at preselected intervals. Despite which way the task is accomplished, the order data and any other statistical information about kiosk use are electronically transferred to the central processing location's microprocessor 40 (block 92). The electronically transmitted information includes the post card orders, the money collected and additional information specific to each kiosk such as the most common post card selected, number of post cards per order, and other sales related information. The information is then sorted by the microprocessor in a desired fashion (Block 104). For example, the post card orders for a specific card are combined, the post cards sent to a particular zip code are combined for ease in mailing or the customer and sales statistics from each kiosk are combined. The microprocessor 40 stores the desired information from the orders to be used later in evaluating the activity at each kiosk. The microprocessor 40 is programmed to display the desired information in an acceptable format such as a screen display or a printout when requested. During the sorting task, the microprocessor 40 is programmed to verify that the entered address contains a proper city, state and zip code through a postnet bar code software such as that available from Electronic Technologies of Rochester Hills, Mich. This software will compare the customer's entered address with a postnet bar code database. The software will add the appropriate post net bar code to the address entered by the customer for assisting the U.S. Post Office in delivering the post card.

The next step is to select (Block 106) the final format of the post card based on the type of address used. If a physical address, i.e., a street address or post office box address, is used, the post cards are printed with the customer entered information and the postnet bar code (block 110). If the postcards are to be delivered via the U.S. Postal Service, a bulk mail postage stamp may also be printed on the postcard. There are a variety of ways in which the post card and text may be printed. A conventional laser printer may be used to print directly on the selected post card or onto an adhesive label that can then be affixed to the selected card. Alternatively, if a duplex color printer is used, the post card design is digitally stored in microprocessor 40 and printed simultaneously with the customer inputted information. The appropriate postage is placed on the card (block 112) and it is sent to the receiver (block 114). The U.S. Postal system or a commercial delivery service is used for the sending of the post card. In an alternative embodiment, the interactive kiosk can include a delivery service selection for the customer to choose the type of delivery.

If an E-mail address is used (block 108), a graphics file is created for digitally storing the selected post card design and customer entered text (block 116). The microprocessor 40 than accesses the Internet and the graphics file is mailed via the Internet (block 118) to the E-mail address.

Figure 6:
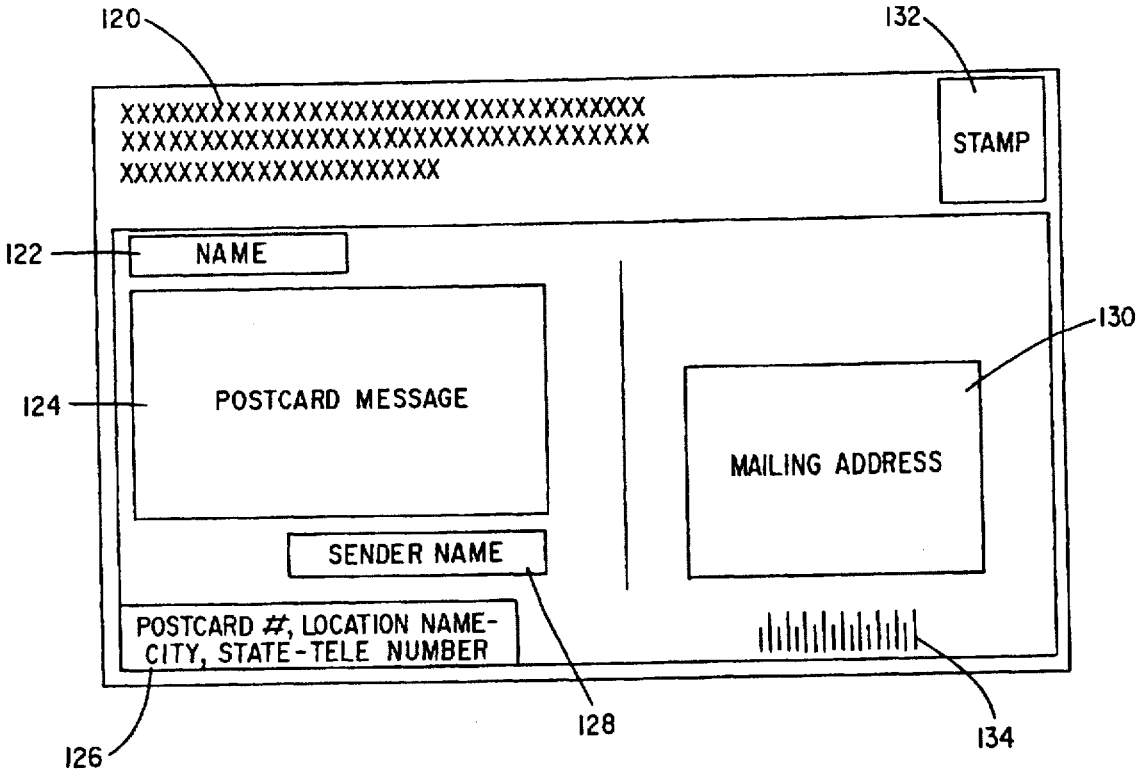
FIG. 6 is a sample of the finished mail piece of the present invention.

FIG. 6 shows a typical finished post card with a description of the post card 120, with the recipient's name 122, the message 124, information about the location from where the post card was sent 126, the sender's name 128, the mailing address 130, the postage 132 and the postnet barcode 134.

This invention has been described in considerable detail in order to comply with the patent statutes and to provide those skilled in the art with the information needed to apply the novel principles and to construct and use the components as are required. However, it is to be understood that the invention will be carried by different equipment and devices and that various modifications, both as to equipment details and operating procedures, can be accomplished without departing from the scope of the invention itself.

What is claimed:

1. A system for providing interaction with a customer for selection of a plurality of mail pieces and subsequent sending of a selected mail piece from said plurality of mail pieces to a selected address, said system comprising:

(a) a kiosk having a communication means including a selection means for prompting said customer to select one of said plurality of mail pieces and an input means for receiving customer entered data to be included on said selected mail piece said input means includes an automatic address search means for searching a database of addresses to match parameters entered by said customer;

(b) a control means supported in kiosk for controlling said communication means and for storing customer entered data; and (c) a finishing means for finishing said selected mail piece with said customer entered data.

2. A system of claim 1 wherein said customer entered data includes an address.

3. A system of claim 1 and further including said finishing means having a postnet bar code search means for finding a postnet bar code that matches said selected address.

4. A system of claim 1 and further including preparing means for preparing said finished selected mail piece for delivery to said selected address.

5. A system of claim 1 wherein said communication means includes an audio format.

6. A system of claim 1 wherein said finishing means prints said customer entered data on said selected mail piece.

7. A system of claim 1 wherein said selected mail piece is a post card.

8. A system of claim 1 wherein said selected mail piece is a note card.

9. A system of claim 1 wherein said control means further includes a calculation means for determining a customer fee and a payment means for accepting said customer fee from said customer.

10. A system of claim 1 and further including a delivery selection means for selecting one of a plurality of delivery means for sending said selected mail piece.

11. A system of claim 1 wherein said communication means includes an interactive visual means.

12. A system of claim 11 wherein said interactive visual means includes a touch screen monitor.

13. A system of claim 1 wherein said finishing means is in a location remote from said kiosk and said customer entered data is electronically transferred to said finishing means.

14. A system of claim 13 and further including a plurality of said kiosks, each said kiosk located in a different area and linked to said finishing means.

15. A system of claim 1 wherein said database of addresses includes electronic mail addresses.

16. A system of claim 15 wherein said preparing means further includes creating a graphics file of said selected mail piece with said customer entered data.

17. A system of claim 16 wherein said finishing means further includes transmission means for transmitting said graphics file to said selected address.

18. A system for providing a customer selection of a mail piece and subsequent sending of a selected mail piece to a selected address, said system comprising:

(a) a kiosk housing;

(b) a monitor supported on said kiosk housing for electronically displaying a plurality of mail pieces;

(c) a communication means coupled to said monitor for prompting customer for selecting one of said plurality of mail pieces;

(d) an input means for receiving customer entered data to be included on a selected one of mail piece;

(e) an address search means for searching a database of addresses to match parameters entered by said customer, said address search means coupled to said input means;

(f) control means supported in said kiosk housing and coupled to said monitor, said communication means and said input means, said control means for controlling the electronic display of said plurality of mail pieces, for controlling the communication means with said customer and for storing said customer entered data; and (g) a finishing means for finishing said mail piece with said customer entered data.

19. A system of claim 18 wherein said communication means includes visual prompts for customer selection of one of said plurality of mail pieces and for entering customer data to be included on said selected mail piece.

20. For a system of claim 18 wherein said communication means includes audio means for communicating with said customer for selecting one of said plurality of mail pieces and for entering data to be included on said selected mail piece.

21. A system of claim 18 and further including said finishing means in a location remote from said kiosk housing.

22. A system of claim 18 wherein said control means further includes calculation means for determining a customer fee and payment means for accepting said customer fee from said customer.

23. A system of claim 18 and further including a delivery selection means for selecting one of a plurality of delivery means for sending said selected mail piece.

24. A system of claim 18 and further including preparing means for preparing said mail piece for delivery to said selected address.

25. A system of claim 24 wherein said preparing means further includes creating a graphics file of said selected mail piece with said customer entered data.

26. A system of claim 25 and further including transmission means for transmitting said selected mail piece to said address.

27. A process for customer selection of a plurality of mail pieces through an interactive kiosk and for subsequent delivery of a selected mail piece to a selected address, said process comprising the steps of:

a) displaying a variety of mail piece designs on said interactive kiosk;

b) communicating with a customer for selecting one of said plurality of mail piece designs and entering data to be included on said selected mail piece;

c) communicating with said customer for determining said selected address for a recipient of said selected mail piece, said selected address determined from an address database;

d) receiving said customer selected mail piece and entered data;

e) transmitting said customer selected mail piece and said entered data to a processing location; and f) preparing at said processing location said customer selected mail piece with said entered data for delivery.

28. The process of claim 27 and further including delivering said customer selected mail piece with said entered data to an address entered by said customer.

29. The process of claim 27 and further including the steps of:

a) receiving recipient information from said customer for determining said recipient address;

b) utilizing said address database for locating an address matching said recipient information; and c) verifying a located address matching said recipient information.

* * * * *